United States Patent [19]

Yamamoto et al.

[11] Patent Number: 4,864,322

[45] Date of Patent: Sep. 5, 1989

[54] APPARATUS FOR REDUCING STRESS ON COMPONENT ELEMENTS DURING EXTENSION AND CONTRACTION OF MOTOR-DRIVEN ANTENNA APPARATUS FOR VEHICLES

[75] Inventors: Akinori Yamamoto, Mie; Kiyomitsu Oshikawa, Toyota; Isaku Kawashima; Kazunori Nakayama, both of Kosai; Yoshiaki Harakawa, Kosai; Takenori Kuno, Toukai; Makoto Watanabe, Aichi, all of Japan

[73] Assignees: Asmo Co., Ltd., Kosai; Nippondenso Co., Ltd., Kariya, both of Japan

[21] Appl. No.: 22,144

[22] Filed: Mar. 5, 1987

[30] Foreign Application Priority Data

Mar. 6, 1986 [JP] Japan ..... 61-49394

[51] Int. Cl.[4] ..... H01Q 1/10

[52] U.S. Cl. ..... 343/903; 318/603; 343/715

[58] Field of Search ..... 343/901, 903, 714, 715; 318/467, 603, 626; 242/54 A

[56] References Cited

U.S. PATENT DOCUMENTS

| | | | |
|---|---|---|---|
| 4,181,268 | 1/1980 | Carolus et al. | 343/903 |
| 4,649,398 | 3/1987 | Yamamoto et al. | 343/903 |

FOREIGN PATENT DOCUMENTS

| | | | |
|---|---|---|---|
| 1275639 | 8/1968 | Fed. Rep. of Germany | 343/903 |
| 2512791 | 10/1976 | Fed. Rep. of Germany | 343/903 |
| 3425391 | 1/1986 | Fed. Rep. of Germany | 343/903 |
| 718339 | 11/1954 | United Kingdom . | |
| 1313676 | 4/1973 | United Kingdom . | |
| 1435493 | 5/1976 | United Kingdom . | |

*Primary Examiner*—Rolf Hille
*Assistant Examiner*—Michael C. Wimer
*Attorney, Agent, or Firm*—Cushman, Darby & Cushman

[57] ABSTRACT

An antenna rod, which is extendible and retractable, is moved up and down by a cable with a rack, and the cable is moved with rotation of a pinion gear. The rotational force of a DC motor is transferred to the pinion gear by a route of a worm, a worm wheel, gears, a damper gear, and a damper. The damper is a coil of resilient metal wire, and both ends of the coiled wire, respectively, engage stopping members, which are provided at the center portions of the damper gear and the pinion gear. When the pinion gear is at a standstill, the rotational energy of the damper gear is accumulated in the damper. The motor is rotated under control of a control circuit in response to the operation of a switch. The drive current for the motor is shut off by a detecting signal from a lock detector during the course of accumulating the rotational energy by the damper. The lead angle of the teeth of the worm is large so that the rotational energy stored in the damper is transferred to the motor.

15 Claims, 9 Drawing Sheets

ST
IG
OFF
52
51
RADIO
ACC
54
TAPE
53
59
V
T1
T2
T3
T4
E
50
55
SET PULSE GENERATOR FOR UP STATE
56
TIMER CIRCUIT FOR UP STATE
58
TIMER CIRCUIT FOR DOWN STATE
57
SET PULSE GENERATOR FOR DOWN STATE
70
71
61
64
60
F/F
S
R
Q
63
62
LOCK DETECTOR
661
65
681
67
66
68
662
682
69
R
F
M
12

ST
IG
OFF
ACC
52
51
53
54
59
T1
T2
T3
T4
50
SET PULSE GENERATOR FOR UP STATE
TIMER CIRCUIT FOR UP STATE
TIMER CIRCUIT FOR DOWN STATE
SET PULSE GENERATOR FOR DOWN STATE
55
56
58
57
70
71
61
64
60
63
F/F
S
R
Q
72
ONE-SHOT CIRCUIT
LOCK DETECTOR
62
75
74
77
76
73
661
65
681
67
66
662
68
682
69
R
F
M
12

APPARATUS FOR REDUCING STRESS ON COMPONENT ELEMENTS DURING EXTENSION AND CONTRACTION OF MOTOR-DRIVEN ANTENNA APPARATUS FOR VEHICLES

BACKGROUND OF THE INVENTION

This invention relates to an electric antenna apparatus carried on vehicles such as automobiles, and more particularly to an antenna apparatus of the motor driven type in which an antenna rod is extended and retracted by a motor by a switch operation.

The motor drive type antenna apparatus of the prior art uses an antenna rod consisting of a plurality of rod members, which are telescopically coupled with one another. The antenna rod is extended and retracted by a motor. This antenna apparatus is constructed so as to provide an upward operation for the extension of the antenna rod as well as a downward operation to retract and receive the antenna rod. It is provided with an operation switch from the generation of the operating instruction. When the switch is set to the upward position, drive power is supplied to the motor and the motor rotates in a first direction to raise the antenna rod. When the switch is set to the downward position in order to retract the antenna rod, on the other hand, the same motor is supplied with drive power of a polarity opposite to that used in the raising operation. This causes the motor to rotate in a second direction, which is opposite to the first direction, thus lowering the antenna rod. When the antenna rod has reached the uppermost position or the lowermost position, the motor is stopped by this switch.

When the antenna rod is at the uppermost and lowermost positions, movement of the motor is impeded and locked. In such an extreme situation, overcurrent flows into the motor, possibly causing burning trouble in the motor. To prevent burning trouble, a torque limiter mechanism has usually been employed in the prior art. However, when the antenna rod is stopped during an up or down operation, the torque limiter mechanism allows the motor per se to slip and rotate.

This mechanism inherently is of a large size. In this respect, the mechanism is undersirable for a motor-driven type antenna apparatus, the size reduction of which is preferable and has been demanded. To cope with this, an electrical control means has been used to detect an extreme increase of the load current, which occurs at the uppermost or lowermost position of the antenna. Upon detection, the control means stops the motor current.

FIG. 15 illustrates how up and down movements of the above antenna rod are controlled. As shown, when the switch is turned on, the motor current abruptly rises at the time of start and settles down to a stationary current for driving the antenna rod. In this stationary state, the antenna rod is moved up. At time t1, the antenna rod is raised up to the extreme end in the up movement of the antenna rod. The rod is then stopped by a stopper so that the rotation of the motor is impeded and locked by a damper mechanism, for example. Therefore, after time t1, load current Im increases. However, when the motor is substantially locked, the motor load current Im is limited at Ic, and a current state as indicated by reference numeral 100 is set up.

To realize such current limit, a current limiting transistor is inserted between the motor and the power source, and the transistor is operated in the active region. To this end, a transistor of a relatively large value is used with a sufficient current capacity. Thus, when a large current flow is present, the heat value is high. Also, since the motor current is limited after a relatively large lock current flows a large rotational torque is generated in the motor. The torque is applied to the various types of parts and components existing between the output shaft of the motor and the antenna rod. When the torque acts on components made of, for example, synthetic resin, such as gears, the so-called creep deformation occurs in the gears. This creates a problem of shortening the liftime of the gears.

To solve this, there is used another control means which uses a timer. The timer sets a time t0 long enough for the antenna rod to reach the uppermost position of the rod. When the control enters the phase of current limiting, the motor current is shut off. In this approach, however, a large torque is still present during the period from time t1 to the shut-off of the motor current, as shown in FIG. 15. In this respect, this approach does not provide a complete solution to the above problem.

Additionally, even if the motor current is shut off, with the rotational torque generated when the current is fed to the motor, the elastic energy is left in the damper mechanism. Therefore, after the motor current is shut off, the residual energy provides a force which acts in the opposite direction to that of the motor rotational direction. This force is applied to the gear mechanism. Thus, the above parts and components continuously are under stress for a long time.

SUMMARY OF THE INVENTION

Accordingly, an object of this invention is to provide an antenna apparatus for use in vehicles with an up and down control function for the antenna's expansion and retracting and, which is substantially free from the above-mentioned problems, and is light in weight and small in size, as well as strong in structure.

Another object of this invention is to provide an antenna appratus with good durability wherein when the antenna rod reaches the stop point and its movement is extremely impeded, great stress is prevented from acting on a reduction gear mechanism, which transfers to the antenna rod the drive force which is applied from the motor and which serves as a power source for moving the antenna rod up and down.

Another object of this invention is to provide an antenna apparatus wherein when the antenna rod reaches the uppermost or lowermost position and the motor is locked, the stress stored until the motor current is shut off can be effectively absorbed, and therefore the stress acting on the reduction gear mechanism is reduced with resultant improvement of the mechanical strength of the rod.

Still another object of this invention is to provide an antenna apparatus in which a damper mechanism for transferring a rotational drive force for the motor is contained so that the damper mechanism accumulates the dynamic energy stored due to the force generated when the motor is locked, and the dynamic energy is effectively released, whereby the stress acting on the gear reduction mechanism can be satisfactorily reduced.

In a motor-drive type antenna apparatus for vehicles according to this invention, the rotation of the motor is transferred via worm gearing to the damper gear. The rotation is the worm gearing is transferred via the damper mechanism to a pinion. A cable coupled with the antenna rod is coupled in mesh with the teeth of the pinion. With such a construction, when the motor rotates, the antenna rod is moved up or down. The damper mechanism also is made of elastic material so that a rotational difference between the damper gear and the pinion is absorbed in the form of elastic deformation. When the antenna rod is locked at the uppermost or lowermost position, therefore, the motion of the damper gear is absorbed by deformation in the damper mechanism. With the shut-off of the motor current, the rotational energy as stored in the damper mechanism is transferred through the damper gear and the worm gears to the motor. Then, the motor rotates in the direction opposite to that of the previous motor rotation.

Thus, when the antenna rod is moved to the extreme position, i.e., the uppermost or lowermost position, the rotational force of the motor is absorbed by the damper mechanism. Therefore, unnecessary stress is not applied to the antenna rod. In the shut-off state of the motor current, the dynamic energy stored in the damper mechanism drives the motor and is consumed by the the motor. As a result, the accumulated energy is completely released, and not stress is accumulated in the reduction gear mechanism. With these features, the antenna apparatus can be made satisfactorily small, and have good durability.

DETAILED DESCRIPTION OF THE PREFERRED EMBODIMENTS

Figure 1:
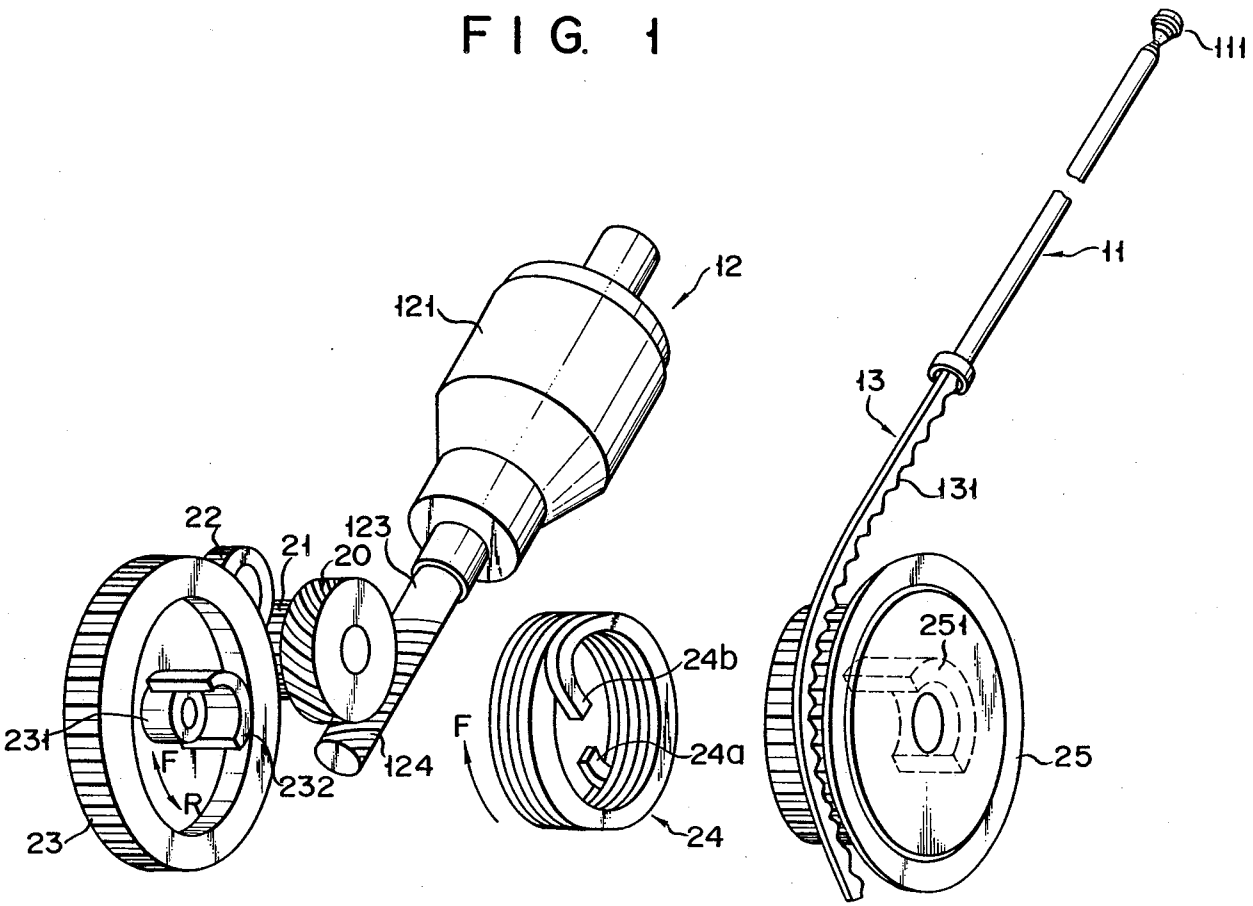
FIG. 1 shows an exploded view of an antenna rod drive mechanism of a motor-driven antenna apparatus according to an embodiment of the present invention.
Figure 2:
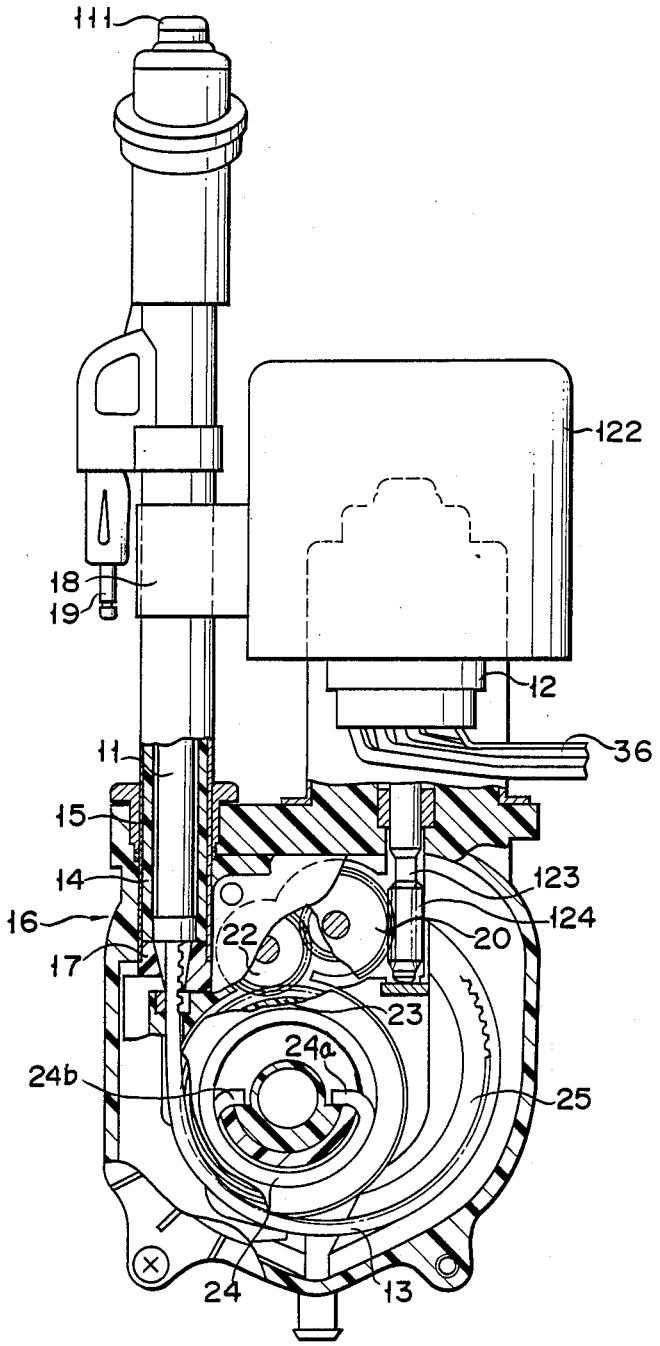
FIG. 2 shows a fragmentary sectional view of the drive mechanism shown in FIG. 1.

FIGS. 1 and 2 show an operating mechanism of a motor-driven antenna. As shown, antenna rod 11 with a plurality of telescopically coupled rod members is extended and retracted by motor 12. Antenna rod 11 is extended by pulling upward the top 111 by fingers, for example. It is retracted by pushing downwardly on the top. In FIG. 1, the antenna rod 11 is illustrated retracted to the minimum.

Antenna rod 11 is made up of a plurality of rod members with different diameters telescopically coupled with one another. The uppermost rod member with the smallest diameter and coupled with top 111 is connected to one end of cable 13 after passing through hollows of other rod members. The other end of the cable is led out from the base of antenna rod 11. As least the portion of cable 13 existing outside antenna rod 11 is provided with rack 131.

Pipe 14, which is made of resin, for example, is applied to the outer periphery of the rod member as the base member of rod antenna 11 for protection purposes, as shown in FIG. 2. Outer tube 15, made which is of aluminum, is provided around resin pipe 14. The base of antenna rod 11 is fixed to housing 16, made which is of synthetic resin, for example. Cable 13 is guided into housing 16 through cable guide 17, made which is of synthetic resin and provided at the base of antenna rod 11. Control unit housing 122 is mounted on the outer tube 15 of antenna rod 11 by means of support member 18. Antenna rod 11 is also fixedly mounted to housing 16, and the output shaft 123 of rotor 121 of motor 12 is guided into housing 16. Outer tube 15 is provided with antenna output terminal 19 connected to antenna rod 11.

Inside housing 16, worm wheel 20 is provided in mesh with worm 124 formed on output shaft 123. Worm wheel 20 is provided with gear 21, both being rotatable around the same axis. The rotational force of gear 21 is also transferred to a damper gear 23 through idle gear 22. Damper gear 23 is also coupled with coiled damper 24, which is made of metal. The rotation of damper gear 23 is transferred through damper 24 to pinion 25. Pinion 25 is in mesh with rack 131 of cable 13 coupled with antenna rod 11. Thus, when pinion 25 rotates, cable 13 is moved to raise or lower antenna rod 11. In this instance, all of the gears except the worm 124 are made of synthetic resin for realizing light weight of the antenna apparatus.

Damper gear 23 has tubular boss 231 at the center portion on the surface of the gear, which faces pinion 25. A support shaft **23*a* (FIG. 4) is set in the center hole of boss 231. Stopping member 232 is mounted around boss 231. Stopping member 232 is shaped as a longitudinally halved tube with a semicircular cross-section and is higher than boss 231. Another stopping member 251, which is shaped like stopping member 232, is mounted at the center portion on the surface of pinion 25 which faces damper gear 23. These stopping members 232 and 251 are inserted in the hollow of coiled damper 24, which is made of metal. Coiled damper 24 has hooks 24*a* and 24*b* at both ends. These hooks are formed by bending the respective ends of the coil wire of damper 24, and these hooks engage stopping members 232 and 251 to transfer the rotation of damper gear 23 to pinion 25**.

When motor 12 is rotated to rotate damper gear 23 in the direction F, for example, the rotation of damper gear 23 is transferred to pinion 25 via damper 24. The pinion 25 rotates to drive cable 13 and raise the top 111 of antenna rod 11. The result is extension of antenna rod 11. Conversely, when motor 12 is rotated in the direction opposite to that in the above case, damper gear 23 is rotated in the direction R. The top 111 of rod 11 is lowered, resulting in retracting of rod 11.

When antenna rod 11 is moved up or down and reaches the uppermost or lowermost position, movement of antenna rod 11, and hence pinion 25 is mechanically impeded. At this time, however, drive power is still applied to motor 12, and the rotational force from motor 12 is still applied to damper gear 23. Under this condition, the rotational energy is accumulated in damper 24, which is located between these gears 23 and 25.

Figure 3A:
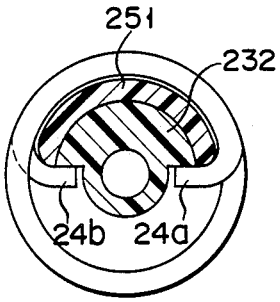
FIGS. 3A to 3C shows schematic illustrations for explaining the operation of the damper mechanism used in the antenna apparatus.
Figure 3B:
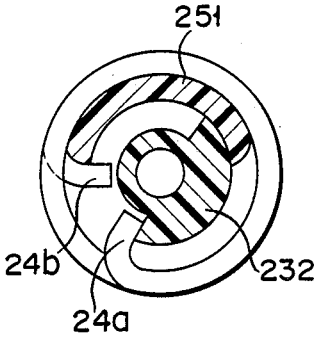
Figure 3C:
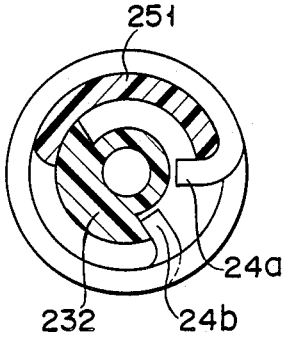

For example, when antenna rod 11 is smoothly movable, and not impeded, stopping member 232 for damper gear 23 and stopping member 251 for pinion 25 are disposed in the positional relationship shown in FIG. 3A. When antenna rod 11 is impeded and movement of stopping member 251 for pinion 25 is impeded, the positional relationship between those stopping members 232 and 251 is as shown in FIG. 3B. Further, it is changed to the positional relationship as shown in FIG. 3C when further rotational force is applied. In this way, the rotational energy is accumulated in damper 24. As the energy accumulation progresses, the load current of motor 12 gradually increases. The detection result of the motor current increase is used to stop the drive current for the motor.

When the motor drive current is shut off, transfer of the rotational force to damper gear 23 is stopped. Now, the accumulated rotational energy of damper 24 reversely rotates damper gear 23. The rotational force applied to the damper gear 23 is transferred through the gear mechanism to motor 12, which is free to rotate. The accumulated energy is consumed by this reverse rotation of motor 12. This operation is continued until that accumulated energy is completely consumed.

The worm reduction mechanism made up of worm 124 and worm wheel 20 is normally used in such a manner that the rotational force is transferred from worm 124 to worm wheel 20. Therefore, in the usual worm reduction mechanism, the transfer of rotational force from the worm wheel to the worm is not allowed for in design. Actually, the lead angle of the tooth of the worm wheel is small in order to secure the mechanical strength of the worm shaft. It is impossible to rotate the worm shaft by the worm wheel. It is known, however, that the rotational force can be transferred from the worm wheel to the worm shaft by using a worm wheel with a large lead ange tooth.

In the worm reduction mechanism used in the antenna apparatus of the present embodiment, the lead angle of the tooth of the worm 124 is large. Therefore, in a situation that the rotational energy accumulated in damper 24 causes the rotation force to act on damper gear 23, the rotation force is transferred to motor 12 through the worm reduction mechanism. The accumulated energy of damper 24 can then be effectively released. While usually the lead angle is set at set at 4° or 9°, the lead angle of worm 124 is set at about 15° in this embodiment.

Figure 4:
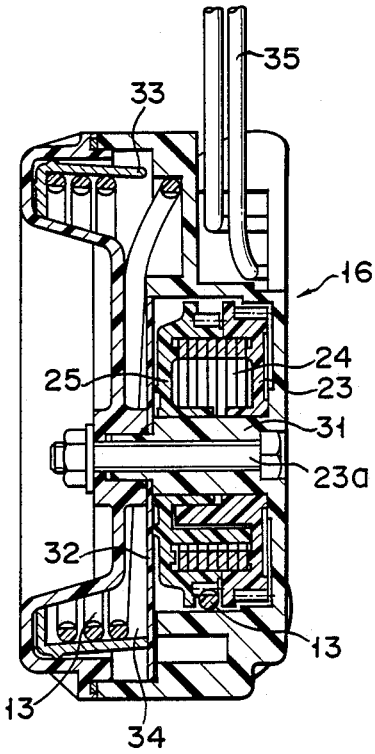
FIG. 4 shows a cross-sectional view for diagrammatically explaining the drive mechanism for the antenna rod, which contains the damper mechanism.

Cable 13, which is guided into housing 16 and meshes with pinion 25, is moved along an arc-shaped guide, which is formed inside housing 16. In housing 16, damper gear 23 and pinion gear 25 are rotatably coupled around fixed shaft 31. Damper gear 23 and pinion 25 are coupled with each other through damper 24. Cable 13, to mesh with pinion gear 25, is moved along a spiral guide, passed through separate 32, and led to drum chamber 34 in which take-up drum 33 is provided coaxial with gears 23 and 25, as shown in FIG. 4. Cable 13, led to drum chamber 34, is inserted into drum 33, and taken up. Lead wire 35, to be connected to motor 12, is lead to a control unit installed in housing 122, for example. The control unit is supplied, through lead wire 36 (FIG. 2), with an antenna operation command signal, electrical power, and the like.

Figure 5:
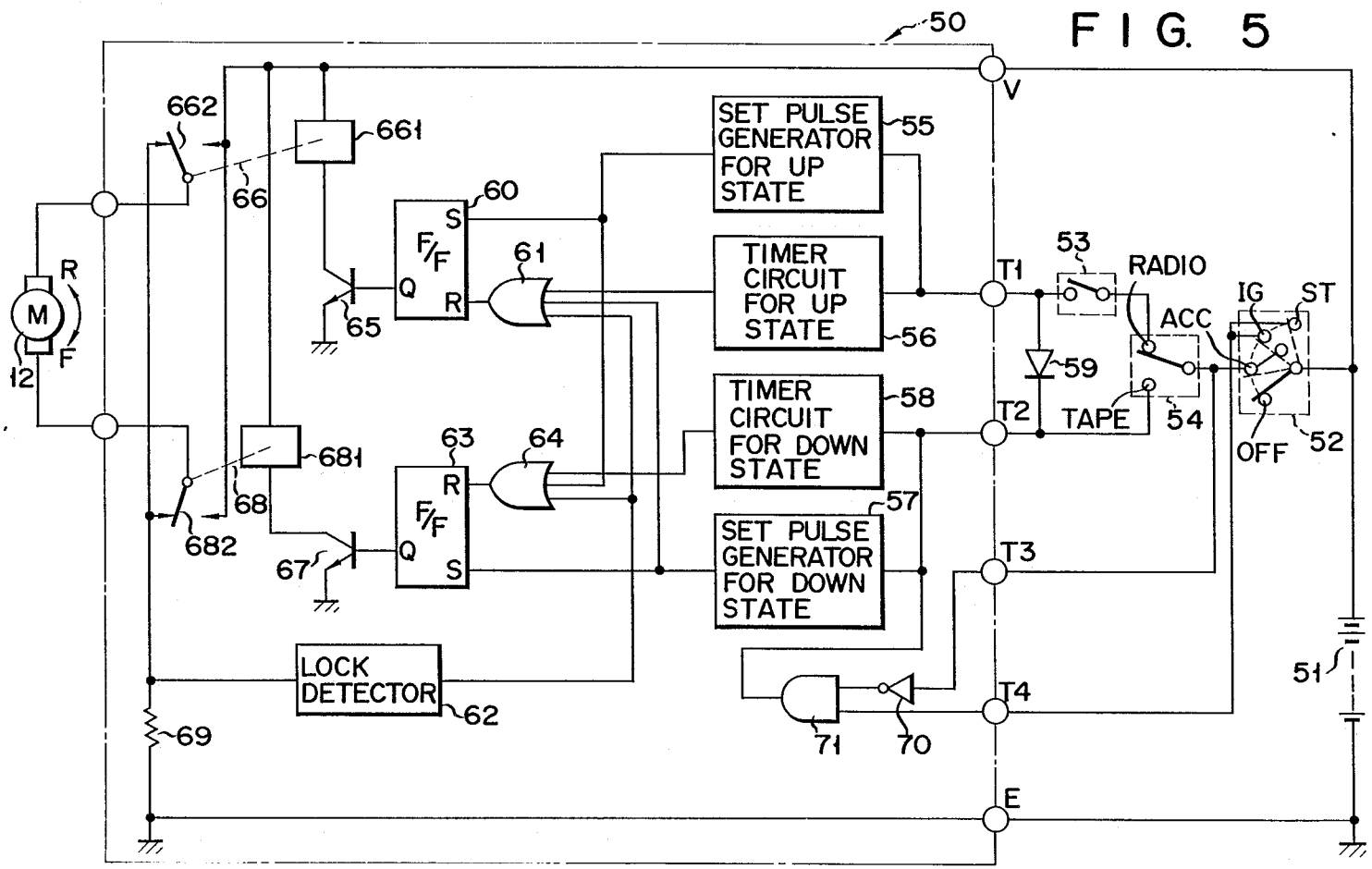
FIG. 5 is a circuit diagram illustrating a control unit for controlling the up and down movement of the antenna rod.

FIG. 5 shows a control circuit 50 housed in control unit housing 122. Control circuit 50 is connected to a DC power source 51, for example, a battery, which is carried on a vehicle. Additionally, it is connected to various types of command signals from ignition switch 52, radio switch 53, and select switch 54 for selecting either a radio or a tape recorder carried on the vehicle.

Ignition switch 52 includes, as is well known, four select positions or terminals, i.e., accessory Acc, ignition IG, starter ST, and OFF. For antenna control, the ignition IG terminal has an auxiliary terminal connected to the accessory Acc terminal. Accessory Acc terminal is connected to select switch 54. The radio select position of switch 54 is connected to terminal T1 of the control circuit 50. It is also connected to terminal T2 via diode 59. Terminal T2 is also connected to the tape-recorder select position of the switch 54. Accessory Acc terminal is connected to terminal T3. Ignition IG terminal and starter ST terminal are connected to terminal T4.

Figure 6:
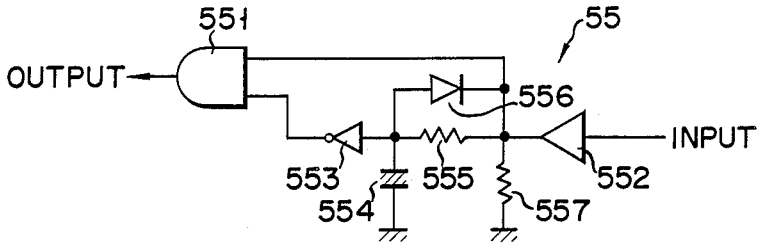
FIGS. 6 through 9 show circuit diagrams of a set pulse generator and a timer circuit, which are contained in the control unit.

Control circuit 50 further includes set pulse genertor 55 for up and timer circuit 56 for up. Set pulse generator 55 and timer circuit 56 are supplied with a signal from terminal T1. Set pulse generator 55 has a configuration as shown in FIG. 6, for example. Pulse generator 55 includes AND gate 551. A first terminal of AND gate 551 is supplied with the input signal via buffer 552, and a second terminal of AND gate 551 is supplied with a signal from capacitor 554 via inverter 553. Capacitor 554 is supplied with the signal from buffer 552 via resistor 555. Finally, capacitor 554 is provided with a discharge circuit made up of diode 556 and resistor 557.

When the input signal is low, the voltage of capacitor 554 is low. Therefore, the output of inverter 553 is high. Under this condition, when the input signal is high, the two input signals to AND gate 551 are both high, and the output signal of AND gate 551 is high. However, when the capacitor 554 is progressively charged, and the voltage of the capacitor is high in level, the output of inverter 553 is inverted to be low. Therefore, for a period of time from the time when the input signal is high until the time when the output of inverter 553 is low, the output signal of pulse generator 55 is high. A pulsative signal is generated, which rises at the timing when the input signal is high. When the input signal is low, on the other hand the charge of capacitor 554 is discharged quickly through diode 556.

Figure 7:
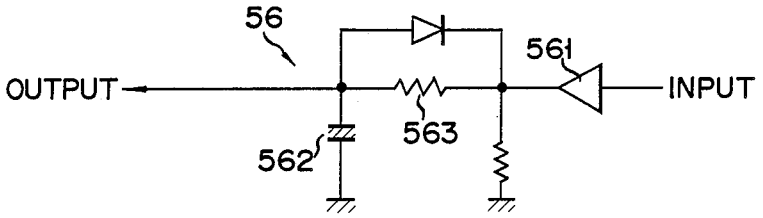

FIG. 7 shows an example of timer circuit 56 for up. The input signal, after passing through buffer 561, is supplied via resistor 563 to capacitor 562 as charge power. Capacitor 562 is charged with a certain time constant. That is to say, if a predetermined time has elapsed since the input signal is high, the output signal of timer circuit 56 for up is high. The time constant is set to a value slightly longer than the time, for example, ten seconds, required for antenna rod 11 to be driven to the uppermost position, after the input signal becomes high.

Figure 8:
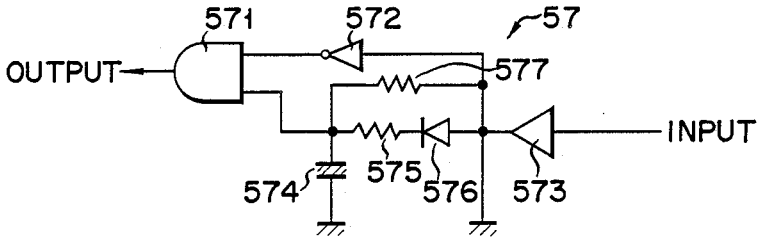

Control circuit 50 further includes set pulse generator 57 for down and timer circuit 58 for down, both of which are supplied with the signal from terminal T2. Set pulse generator 57 has a configuration shown in FIG. 8, for example. Pulse generator 57 includes AND gate 571. The input signal is supplied to buffer 573, and the signal from buffer 573 is supplied to a first terminal of AND gate 571 via inverter 572. Thus, when the input signal is low, a high-level signal is supplied to the first terminal of AND gate 571. A second terminal of AND gate 571 is applied with a terminal voltage of capacitor 574. Capacitor 574 is supplied with a signal from buffer 573 via forward diode 576 and resistor 575. When the input signal is high, capacitor 574 is charged. When the input signal is low, on the other hand, capacitor 574 is discharged with a time constant, by way of resistor 577. Accordingly, set pulse generator 57 generates a pulse output signal when the input level is inverted from high to low.

Figure 9:
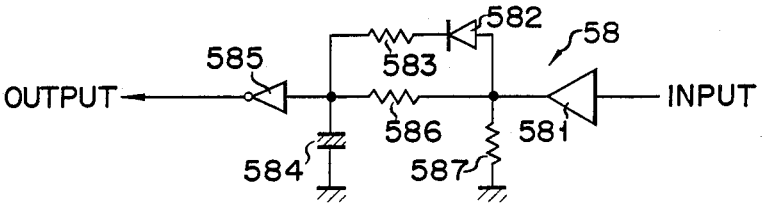

FIG. 9 shows an example of timer circuit 58 for down. An input signal is supplied to buffer 581, and the output signal of buffer 581 is supplied via diode 582 and resistor 583 to capacitor 584 to charge the capacitor 584. The capacitor is charged when the input signal at a high level, and the voltage at the terminal of capacitor 584 is taken out via inverter 585 as an output signal. Capacitor 584 is provided with a discharge circuit made up of resistors 586 and 587. When the input signal is low in level, the charge of capacitor 584 is discharged at a time constant of about ten seconds, for example. This time constant is slightly longer than the time required for the antenna rod to be driven from the uppermost position to the lowermost position. In other words, when a predetermined time, for example, ten seconds, has elapsed since the input signal is changed from high to low, the output signal from timer circuit 58 rises.

The output signal from set pulse generator 55 for up is supplied to flip/flop 60 for up operation setting, as a set command. When ignition switch 52 is set to the position of either accessory Acc or ignition IG, radio switch 53 is turned on, and the select switch 54 is set to the radio position, flip/flop 60 is set by the output signal from set pulse generator 55. The reset terminal of flip/flop 60 then is supplied with the output signal from OR gate 61. OR gate 61 is supplied with the output signal from timer circuit 56 for up, the output signal from set pulse generator 57 for down, and the output signal from lock detector 62.

The output signal from set pulse generator 57 for down is also supplied to flip/flop 63 for lowering operation setting, as a set command. The reset terminal of flip/flop 63 is supplied with the reset command from OR gate 64. OR gate 64 is supplied with the output signal from timer circuit 58 for down, the output signal from set pulse generator 55 for up, and the output signal from lock detector 62.

The output signal of flip-flop 60, which is produced when the flip/flop is set, turns on transistor 65. By the turning on of transistor 65, excited coil 661 of relay 66 for up is supplied with exciting current. The drive power is supplied through relay contact 662 to motor 12. Motor 12 is then rotated in the F direction to drive the antenna rod in the up direction. On the other hand, when flip-flop 63 is set, transistor 67 is turned on. By the turning on of the transistor 67, exciting current is sent through excited coil 681 of relay 68 for down. The drive current flows through relay contact 682 to motor 12. The drive current causes motor 12 to rotate in the direction R, opposite to that of the raising operation. Thus, the antenna rod is driven in the down direction.

The current running through motor 12 is led to the grounded circuit via current-detecting resistor 69. The voltage drop across resistor 69 is monitored by lock detector 62. Specifically, when antenna rod 11 is impeded in motion, the load current flowing through motor 12 becomes large, and the voltage drop across resistor 69 is large, this large voltage drop is detected by lock detector 62. Upon detection, lock detector 62 supplies a signal to OR gates 61 and 64.

Figure 10:
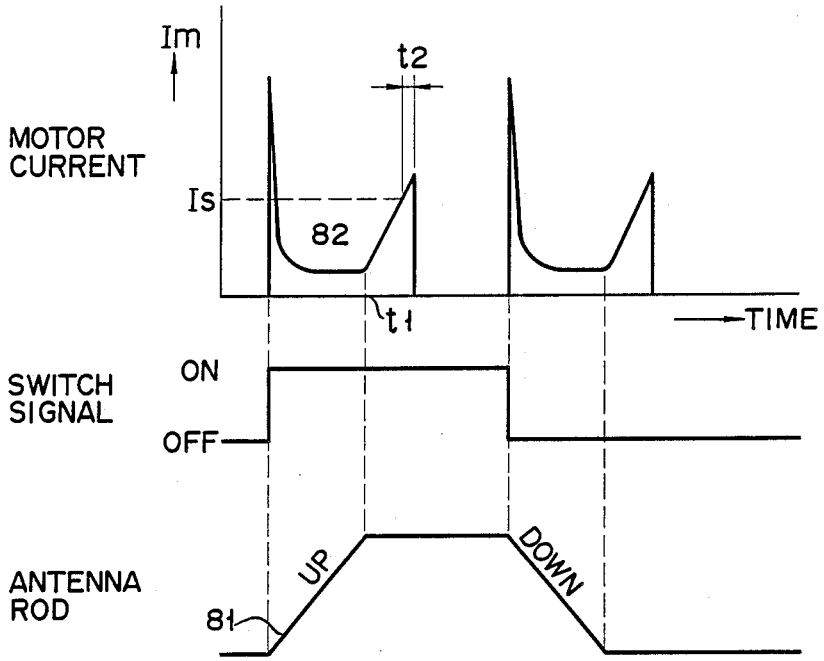
FIG. 10 shows a timing chart useful in explaining the operation of the antenna apparatus.

The signal from terminal T3 of control circuit 50 is supplied to AND gate 71 via inverter 70. AND gate 71 is also supplied with the signal from terminal T4. The output signal from AND gate 71 is supplied to set pulse generator 57 for down and timer circuit 58 for down, as an input signal. More specifically, when ignition switch 52 is set to the position of either accessory Acc or ignition IG, and select switch 54 is set to the radio position, if radio switch 53 is turned on, as shown in FIG. 10, set pulse generator 55 generates a pulse signal. By this pulse signal, flip/flop 60 is set. Then, the drive current is supplied to motor 12. Motor 12 is rotated in the F direction, and the antenna rod is raised. At this time, ruch current instantaneously flows; however, the rush current is immediately settled down to normal current value 82. During the time when the constant current value is kept, antenna rod 11 is raised. The state of damper 24 at this time is as shown in FIG. 3A.

When antenna rod 11 is raised and reaches the uppermost position at time t1, antenna rod 11 is stopped, and pinion gear 25 is impeded. The rotating force of damper gear 23 is accumulated in damper 24, as shown in FIG. 3B. Accordingly, the load current of motor 12 is increased. When damper 24 is as illustrated in FIG. 3B, and the load current of motor 12 is increased above Is, this is detected by lock detector 62. Lock detector 62 resets flip/flop 60 to cause the drive current to motor 12 to be shut off. When the drive current of motor 12 is shut off, motor 12 can be freely rotated by an external force. The rotating force accumulated in damper 24 is transmitted to motor 12 via reduction gears so as to cause motor 12 to rotate. In this way, the energy accumulated in damper 24 is released.

When radio switch 53 is turned on, the signal from set pulse generator 55 for up is supplied to the reset terminal of flip/flop 63 via OR gate 64. In this way, it is verified that relay 68 for down is set to the off condition in response to the raising operation of the antenna rod.

When antenna rod 11 has reached its uppermost position, even if this state is not detected for some reason or other, flip/flop 60 is reset by the output of timer circuit 56 after a predetermined time has elapsed since radio switch 53 is turned on. In this way, the drive current to motor 12, now rotating in the up direction, is shut off.

When antenna rod 11 is set to the raising operation, if radio switch 53 is turned off, the signal as supplied via diode 59 to set pulse generator 57 for down and timer circuit 58 for down is changed from high level to low. Accordingly, a pulse signal is generated by set pulse generator 57. This signal sets flip/flop 63 for down. By the setting, transistor 67 is turned on, and exciting current is supplied to exciting coil 681 of relay 68. Accordingly, drive current is supplied to motor 12 via relay contact 682. The drive current causes motor 12 to rotate in the lowering direction R. Antenna rod 11 is driven in the lowering direction. When antenna 11 reaches its lowermost position and is impeded, the rotating force of motor 12 is absorbed by damper 24 in the same manner as that for the raising operation. The load current is then increased. The detect signal from lock detector 62 resets flip/flop 63, and the current supplied to motor 12 is shut off. When the drive current to motor 12 is shut off, the energy that has been stored in damper 24 is transmitted to motor 12 via reduction worm gears to release the energy from damper 24.

When ignition switch 52 is set to the accessory Acc position and the radio is turned on, if ignition switch 52 is switched to the starter ST position for engine start, the input signals at terminals T1 and T2 are changed from high level to low. Accordingly, a pulse signal is output by set pulse generator 57 for down to start time circuit 58 for down. Antenna rod 11 is then lowered. However, when ignition switch 52 is at the starter ST position, the signal at terminal T3 is at low level, and the signal at terminal T4 is high. The output signal from AND gate 71 is also high. Therefore, the set pulse generator 57 for down and timer circuit 58 for down are not operated, and antenna rod 11 is held in the raised state.

In the embodiment as mentioned above, select switch 54 may be set to the tape side when a tape cassette is loaded in a cassette tape recorder. In the usual use of the tape recorder, the tape cassette is frequently loaded and unloaded. Therefore, it should be avoided that the up and down control of the antenna movement is effected every time the cassette is loaded and unloaded. It is noted that in the antenna apparatus under discussion, if select switch 54 is set to the cassette side, the input signals of set pulse generator 57 and timer circuit 58 are kept high. Therefore, the down operation of the antenna rod 11 is never performed.

Figures 11A, 11B, 11C:
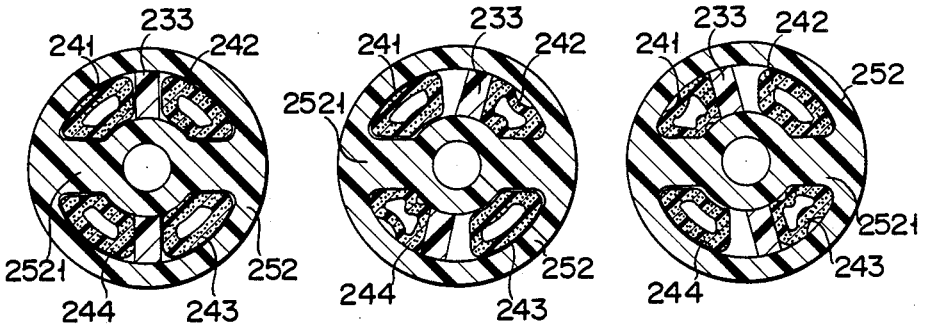
FIGS. 11A through 11C show schematic diagrams of another damper mechanism.

Turning now to FIGS. 11A to 11C, another embodiment of the damper mechanism is illustrated. Stopping member 233 mounted to damper gear 23 is a plate member extending from the center to both sides. Stopping member 252 mounted to pinion gear 25 is a tubular member provided surrounding stopping member 233. The tubular member 252 includes partitioning wall 2521 extending in the diametrical direction of the tubular member. When stopping members 233 and 252 are combined for assemblage, four spaces are formed in the tubular member. Four damper members 241 to 244 are housed in these spaces. Each of the damper members is made of elastic material such as rubber and shaped like a sleeve. When pinion gear 25 is smoothly rotatable, damper members 241 and 244 transfer the rotational force of damper gear 23 to pinion gear 25 without any deformation of these members, as shown in FIG. 11A. When antenna rod 11 raises and reaches the uppermost position and the rotation of pinion gear 25 is extremely impeded, however, damper memers 241 to 244 are deformed as shown in FIGS. 11B and 11C, and accumulate the rotational energy of damper gear 23.

In the embodiments thus far mentioned, the movement of antenna rod 11 is greatly impeded, and the rotational energy of motor 12 is accumulated in the damper mechanism. The accumulated energy is released by transferring it to the motor via the worm reduction mechanism after the motor current is shut off. Alternatively, the accumulated energy may be released by controlling motor 12 so as to rotate the motor intentionally in the reverse direction.

Figure 12:
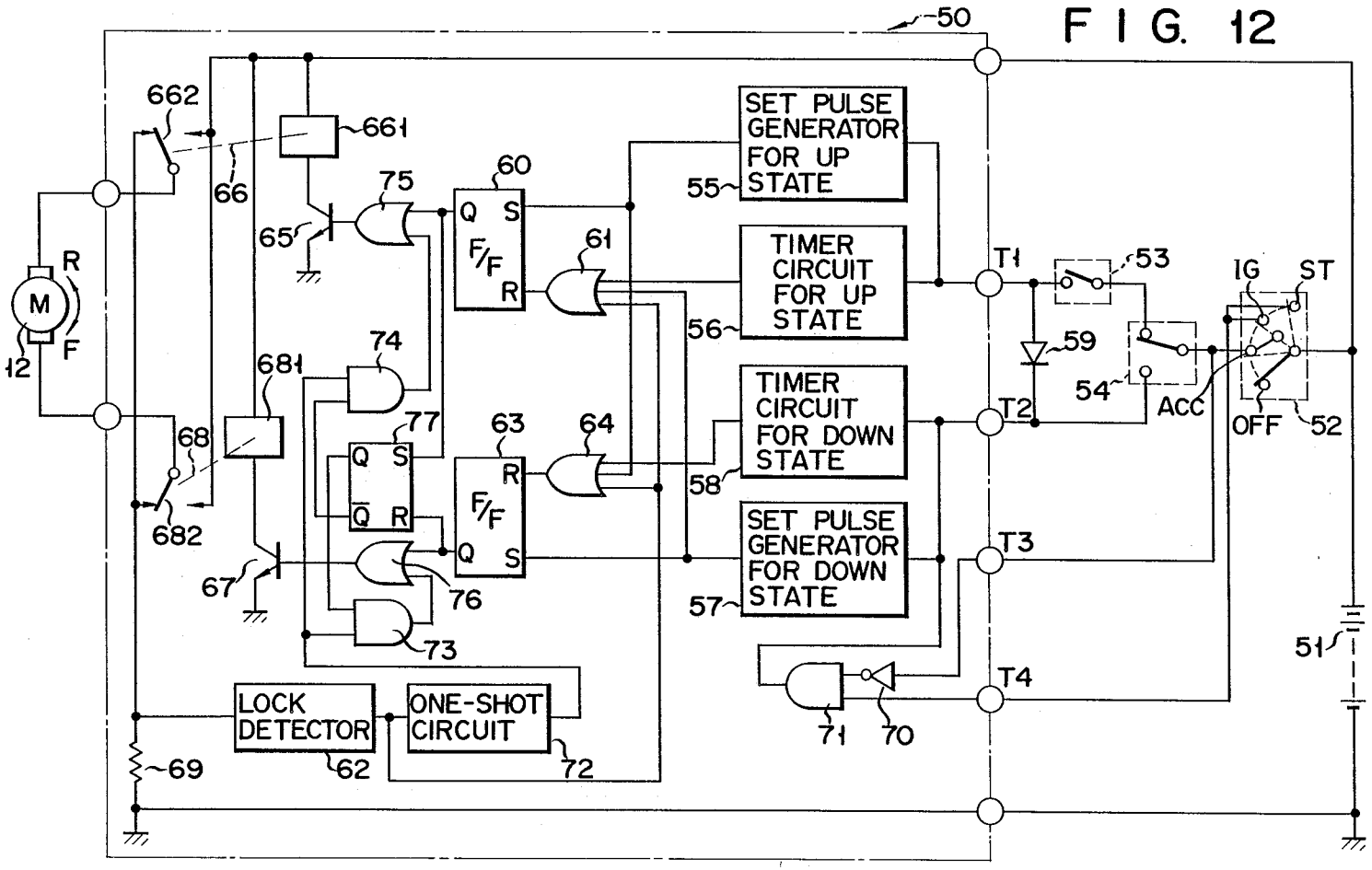
FIG. 12 shows a circuit diagram of another control unit used in the antenna apparatus.

FIG. 12 shows a configuration of control circuit 50 for executing the motor control. The control circuit 50 of this embodiment is substantially the same as that of FIG. 5. The same components as those in FIG. 5 are designated by the same reference numerals, and the description of those elements will be omitted.

In control circuit 50, the output signal from lock detector 62 is supplied to one-shot circuit 72. When the locked state of antenna rod 11 is detected, one-shot circuit 72 generates a pulse signal with a fixed pulse width. This pulse width is set to such a value that motor 12 will be rotated in an amount necessary for the energy accumulated in the damper mechanism to be released. The output pulse signal from one-shot circuit 72 is supplied to AND gates 73 and 74 as their gate signals.

The output of flip/flop 60 for up, when it is set, is supplied directly to the set terminal of flip/flop 77, and also to the base of transistor 65 via OR gate 75. Similarly, the output of flip/flop 63 for down, when it it set, is supplied directly to the reset terminal of flip/flop 77, and also the base of transistor 67 via OR gate 76. When antenna rod 11 is raised, flip/flop 77 is set, and when antenna rod 11 is lowered, it is reset. Output signal Q of flip/flop 77, when it is set, is supplied to AND gate 73. Output signal $\overline{Q}$ of flip/flop 77, when it is reset, is supplied to AND gate 74. More specifically, when flip/flop 60 is set, and antenna rod 11 is raised, if antenna rod 11 reaches the uppermost position and stops, this stoppage is detected by lock detector 62. Then, flip/flop 60 is reset, and the motor current is shut off. When lock detector 62 outputs a detect signal, one-shot circuit 72 generates a one-shot pulse in response to this detect signal. As the result of the setting of flip/flop 60, flip/-flop 77 is set.

In response to the one-shot pulse, AND gate 73 generates an output signal. This signal is supplied via OR gate 76 to transistor 67. Then relay 68 is operated, and motor 12 is rotated in the down direction R for the time width corresponding to the one-shot pulse. In this way, the energy as accumulated in the damper mechanism when antenna rod 11 has reached the uppermost position and is stopped is released through the reverse rotation of motor 12.

Also, when flip/flop 63 is set and antenna rod 11 is lowered, if antenna rod 11 has reached the lowermost position and lock detector 62 outputs a detect signal, a one-shot pulse is generated. At this time, since flip/flop 77 has been reset by the output signal of flip/flop 63, AND gate 74 outputs a signal corresponding to the oneshot pulse. This signal turns on transistor 65, and motor 12 is driven in the up direction F. When antenna rod 11 is lowered and locked, the energy accumulated in the damper mechanism is released.

For one-shot circuit 72, a known monostable multivibrator may be used. Lock detector 62 may be realized by various circuits. For example, it can be constructed as shown in FIG. 13.

Figure 13:
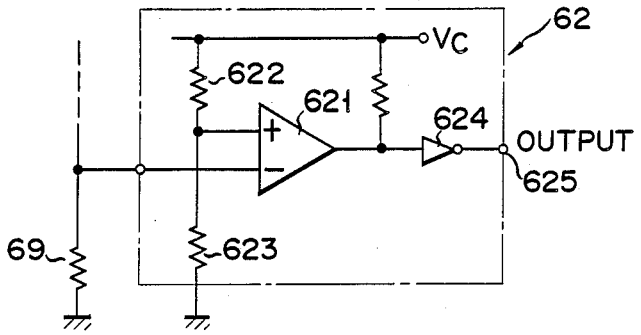
FIG. 13 shows a circuit diagram of a lock detector in the control unit.

As shown in FIG. 13, lock detector 62 includes an open collector type comparator 621. The positive terminal of comparator 621 is applied with a reference potential as obtained by voltage-dividing a fixed voltage power supply Vc by resistors 622 and 623. The negative terminal of comparator 621 is applied with the voltage across resistor 69. When the motor current is increased, and the voltage of resistor 69 becomes larger than the reference voltage as set by resistors 622 and 623, the output signal of comparator 621 becomes negative. The logical state of the output signal from comparator 621 is inverted by inverter 624 and the inverted signal is output from output terminal 625. In this way, when motor 12 is locked, and the load current is increased, the output signal of lock detector 62 becomes high.

Figure 14:
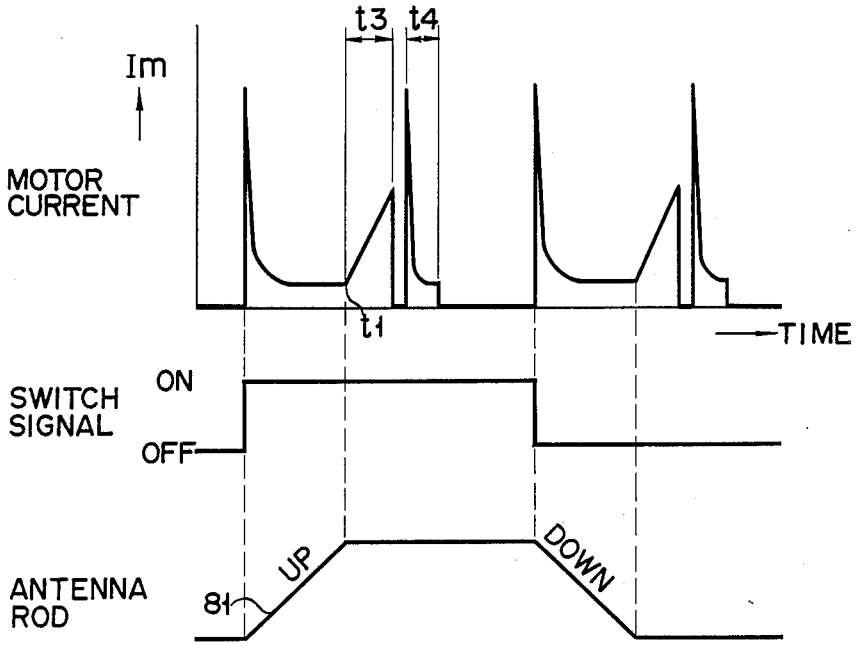
FIG. 14 shows a timing chart for explaining the operation of the antenna rod by the control unit of FIG. 12.
Figure 15:
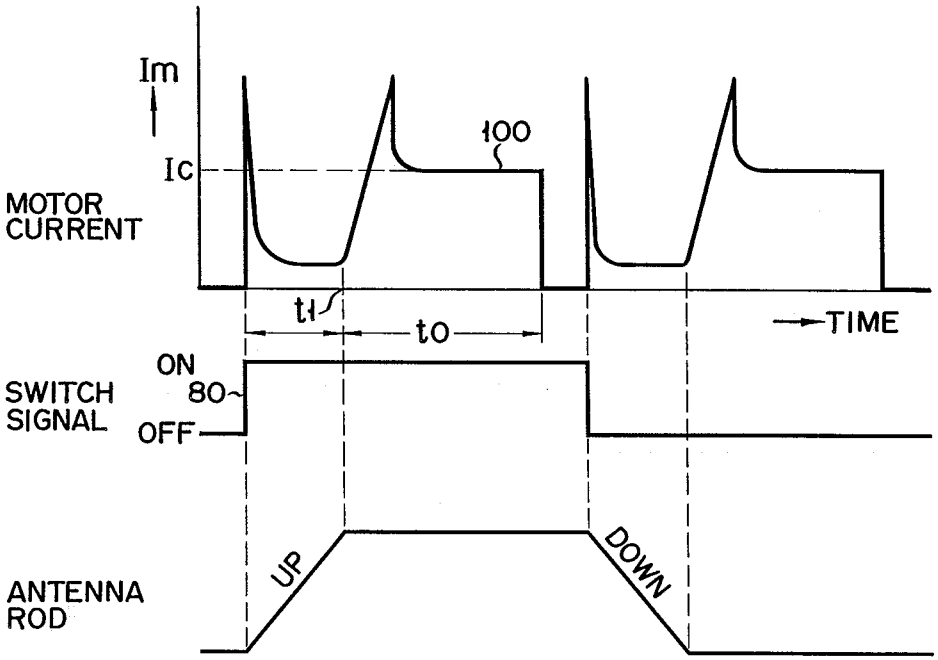
FIG. 15 (PRIOR ART)
FIG. 15 shows a set of waveforms for explaining a variation of the motor current in the prior art control means for the antenna rod in comparison with the movement of the antenna rod.

FIG. 14 graphically describes the control of antenna rod 11 by control circuit 50 of FIG. 12. When the ratio switch is turned on, a switch signal rises. Then motor 12 is driven and the load current rises in the same way as in FIG. 10. When antenna rod is locked at time t1, the load current of motor 12 is increased, and the rotational energy is accumulated in the damper mechanism. When the locked state is detected by lock detector 62, the motor current is shut off. Therefore, the damper mechanism accumulates the energy generated during a period t3, from the time when the antenna rod 11 is stopped until the motor current is shut off.

As described above, when lock detector 62 generates a detect signal, one-shot circuit 72 generates a oneshot pulse, and motor 12 is rotated in the opposite direction during time period t4. The energy accumulated in damper mechanism during time t3 is therefore released. After a short time after lock detector 62 generates a lock detect signal, one-shot circuit 72 is operated to supply current to the motor so that the motor rotates in the opposite direction, as shown in FIG. 14. In this way, the gear mechanism can be effectively protected from the application of unnecessary force.

To lower the raised antenna rod 11, a similar operation will be performed at the fall of a switch signal from radio switch 53 when it is turned off.

In this embodiment, unlike the first embodiment, the lead angle of worm gear 124 need not be particularly large. The lead angle may be set to the same value as that used for the normal worm gear mechanism.

In this embodiment, for damper 24 and 241 to 244 which make up the damper mechanism, a spring mechanism made of metal, or a mechanism made of elastic material such as rubber, is used. However, it may be any mechanism if it can be deformed when a load weight is applied, accumulate the energy, and release the energy when the load weight is removed.

The operating condition of the damper mechanism must be set up in connection with the detecting operation of lock detector 62. Specifically, during the course of time that damper 24 is accumulating the elastic strain energy, lock detector 62 must stop motor 12. If the accumulating capacity of damper 24 is small, and the lock detector 62 cannot detect the locked state within the operating time duration of damper 24, then motor 12 is stopped in a mechanical way, and lock detector 62 detects the locked state when the load current is greatly increased. In such a state, motor 12 is applied with excessive lock torque. Therefore, the durability of motor 12 and that of the gear mechanism are impaired.

In order for lock detector 62 to detect the locked state at an appropriate position of the antenna rod, it is desirable that, from the time (t1 in FIG. 10) when damper 24 starts to accumulate the elastic strain energy, the motor current is increased at a predetermined slope. In this case, if the slope is too gentle, much time is consumed for shutting off the motor current. If the slope is too steep, the operating time duration of the damper is limited, and therefore, it becomes difficult to perform an appropriate current shut-off control. Therefore, the elasticity constants of dampers 24 and 241 to 244 must be set to appropriate values.

What is claimed is:

1. A motor-driven antenna apparatus for vehicles, comprising:

an antenna rod driven up and down for extension and retraction;

a motor with a rotational direction as determined by the direction of a motor drive current applied thereto;

a reduction gear mechanism for receiving a rotational force from said motor;

a pinion gear coupled with an up- and down-drive member connected to said antenna rod, said antenna rod being moved up and down with rotation of said pinion gear;

damper means located between said reduction gear mechanism and said pinion gear and serving as rotational force transmitting means, and said damper means being capable of accumulating the rotational energy in the form of elastic strain energy when said pinion gear is stopped but the rotational force exists in said reduction gear mechanism, the energy accumulated in said damper means being applied as the rotational force to said reduction gear mechanism so as to rotate said motor reversely when the rotational force of said motor is not transmitted to said reduction gear mechanism;

control means including means for generating said motor drive current to rotate said motor and to move said antenna rod up or down in response to a command from switch means for selecting up or down movement of said antenna rod, means for detecting a situation that said pinion fear is stopped and that the rotational energy is accumulated in said damper means, and means for shutting off the motor drive current when said detecting means detects said situation; and pulse generating means for producing a pulsative signal in response to an output signal of said detecting means, said motor being reversely rotated during a period corresponding to the duration of said pulsative signal generated by said pulse generating means, the accumulated energy of said damper means being released through the reverse rotation of said motor.

2. An apparatus according to claim 1, in which said control means includes a resistor supplied with a load current flowing through a load and for detecting said load current, the voltage detected by said resistor being supplied to said detecting means, and said detecting means detecting a value of the load current, the detected load current being higher than the load current value in a normal load but lower than the load current value when the rotation of said motor is impeded to such a degree that said motor is stopped.

3. An apparatus according to claim 1, in which said control means includes means for detecting a load current flowing through said motor, lock-detecting means for generating an output signal when the laod current detected by the detecting means exceeds a predetermined value, means for generating a pulse signal in accordance with the output signal from the lock-detecting means, and means for generating a motor-driven current which reversely rotates said motor within a time interval corresponding to the pulse width of the signal generated by the pulse signal-generating means.

4. An apparatus according to claim 3, in which said pulse signal-generating means includes a one-shot circuit for generating a pulse signal having a pulse width determined from a time point at which the output signal from the lock-detecting means begins to rise.

5. A motor-driven antenna apparatus for vehicles, comprising:

an antenna rod driven up and down for extension and retraction;

a motor with a rotational direction as determined by the direction of a motor drive current applied thereto;

a reduction gear mechanism for receiving a rotational force from said motor;

a pinion gear coupled with an up- and down-drive member connected to said antenna rod, said antenna rod being moved up and down with rotation of said pinion gear;

damper means located between said reduction gear mechanism and said pinion gear and serving as rotational force transmitting means, said damper means being capable of accumulating the rotational energy in the form of elastic strain energy when said pinion gear is stopped but the rotational force exists in said reduction gear mechanism, the energy accumulated in said damper means being applied as the rotational force to said reduction gear mechanism so as to rotate said motor reversely when the rotational force of said motor is not transmitted to said reduction gear mechanism; and control means including means for generating said motor drive current to rotate said motor and to move said antenna rod up or down in response to a command from switch means for selecting up or down movement of said antenna rod, means for detecting a situation that said pinion gear is stopped and that the rotational energy is accumulated in said damper means, and means for shutting off the motor drive current when said detecting means detects said situation, wherein said damper means includes a damper comprising a coil of resilient metal wire and first and second hooks which are formed by bending both ends of said metal wire toward the rotational axis of said damper, said first and second hooks

6. An apparatus according to claim 5, in which said stopping member for said damper gear is a tubular member with a semicircular cross-section which stands erect at the center portion of said damper gear, said stopping member for said pinion gear is a tubular member with a semicircular cross-section which stands erect at the center portion of said pinion gear, said tubular members being arranged overlapping and coaxial with each other, said damper is located around said tubular members, and said hooks engage the side walls of said stopping members, respectively.

7. An apparatus according to claim 6, in which said damper gear, said pinion gear, and said stopping members are made of synthetic resin, and said pinion gear meshes with a rack of a cable, which is made of synthetic resin and coupled with said antenna rod.

8. An apparatus according to claim 5, in which said reduction gear mechanism includes a worm and a worm wheel, said worm is formed on a metal output shaft of said motor, said worm wheel and said pinion gear are made of synthetic resin, and said pinion gear meshes with a cable for moving said antenna rod up and down.

9. An apparatus according to claim 5, in which said control means includes timer means for up and down, said timer means being driven by a signal from said switch means for selecting the up or down movement of said antenna rod, each of said timer means shutting off the drive current to said motor after a specific time after said switch means produces an up or down command signal.

10. An apparatus according to claim 5, further comprising a pulse generating means for producing a pulsative signal in response to an output signal of said detecting means, said motor being reversely rotated during a period corresponding to the duration of said pulsative signal generated by said pulse generating means, the accumulated energy of said damper means being released through the reverse rotation of said motor.

11. An apparatus according to claim 5, in which said control means includes a resistor supplied with a load current flowing through a load and for detecting said load current, the voltage detected by said resistor being supplied to said detecting means, and said detecting means detecting a value of the load current, the detected load current value being higher than the load current value in a normal load but lower than the load current value when the rotation of said motor is impeded to such a degree that said motor is stopped.

12. An apparatus according to claim 5, in which said control means includes a means for detecting a load current flow through said motor, a lock-detecting means for generating an output signal when the load current detected by the detecting means exceeds a predetermined value, means for generating a pulse signal in accordance with the output signal from the lock-detecting means, and means for generating a motor-driving current which reversely rotates said motor within a time interval corresponding to the pulse width of the signal generated by the pulse signal-generating means.

13. An apparatus according to claim 12, in which said pulse signal-generating means includes a one-shot circuit for generating a pulse signal having a pulse width determined from a time point at which the output signal from the lock-detecting means begins to rise. engaging a stopping member formed on a damper gear which is rotated by said reduction gear mechanism and engaging another stopping member formed on said pinion gear, respectively, and the rotation of said damper gear being transferred to said pinion gear through said damper.

14. An apparatus according to claim 5, wherein said reduction gear mechanism includes a worm having teeth, said worm being rotationally driven by said motor, and a worm gear to mesh with said worm, a lead angle of the teeth of said worm being so selected that said worm is rotated with said motor when a rotational force is being applied to said worm gear.

15. An apparatus according to claim 14, in which the lead angle of the teeth of said worm is approximately 15°.

* * * * *